United States Patent [19]

Naitou

[11] Patent Number: 4,849,767

[45] Date of Patent: Jul. 18, 1989

[54] HELICAL ANTENNA FOR SMALL PORTABLE WIRELESS DEVICES

[75] Inventor: Katsumi Naitou, Ehime, Japan

[73] Assignee: Nippon Tsushin Densen Company, Ltd., Yahatahama, Japan

[21] Appl. No.: 127,451

[22] Filed: Dec. 2, 1987

[30] Foreign Application Priority Data

Apr. 21, 1987 [JP] Japan ..... 62-060562[U]

[51] Int. Cl.[4] ..... H01Q 1/36

[52] U.S. Cl. ..... 343/745; 343/895

[58] Field of Search ..... 343/745, 747, 748, 750, 343/895, 702, 744, 866, 867, 787, 788

[56] References Cited

U.S. PATENT DOCUMENTS 3,474,453 10/1969 Ireland ..... 343/745
3,487,463 12/1969 Rogers ..... 343/745
3,523,251 8/1970 Halstead ..... 343/895
3,781,899 12/1973 Lockwood ..... 343/895
4,163,981 8/1979 Wilson ..... 343/895

*Primary Examiner*—William L. Sikes
*Assistant Examiner*—Michael C. Wimer
*Attorney, Agent, or Firm*—Cushman, Darby & Cushman

[57] ABSTRACT

A helical antenna for use with small portable wireless devices as disclosed which includes a magnetic tuner including a magnet adapted to move in a direction substantially perpendicular to the longitudinal axis of the antenna whereby the impedence of the antenna can be varied greatly by displacement of the magnet only a short distance. The antenna preferably further includes a variable capacitor for reducing any mismatching between the input impedence of the antenna and the characteristic impedence of an associated feeder which can be caused by adjusting the magnetic tuner.

6 Claims, 6 Drawing Sheets

HELICAL ANTENNA FOR SMALL PORTABLE WIRELESS DEVICES

BACKGROUND OF THE INVENTION

The present invention relates to helical antennas for portable wireless devices and, more particularly, to a helical antenna including a magnetic tune for selectively receiving electrical waves of a particular frequency and a capacitance adjuster for reducing any mismatching between the characteristic impedance of an associated antenna feeder and the input impedance of the antenna resultant from varying the inductance of the antenna coil with the magnetic tuner.

Selective reception of a particular frequency among several discrete frequencies is often required for small portable wireless devices. Thus, the antenna or input circuit of a wireless device, for example, is preferably designed so that its inductance can be varied to tune the device into an electromagnetic wave of particular frequency.

In an attempt to meet this demand, conventional small portable wireless devices have been provided with a helical antenna whose inductance may be varied. Such a helical antenna is shown, for example, in FIG. 6. This antenna includes a hollow tube 1′ with an antenna element 2′ wound thereabout so as to form a coil. The tube 1′ has an antenna connector 3′ at the bottom end thereof and an antenna cap 4′ at its upper end. The antenna further includes a frequency-tuning ferrite magnet 5′ which is vertically movably fixed to the inside of the hollow tube 1′. As is apparent, with this arrangement the inductance of the coil can be varied by varying the vertical displacement of the magnet. The tuning ferrite magnet can be moved vertically and will stay at a selected position within the antenna coil. This enables, apparently, the selective reception by the wireless device of an electromagnetic wave of particular frequency.

It has been found, however, that the input impedance of the antenna will vary as the ferrite magnet is moved to vary the inductance of the coil and therefore the input impedance will no longer match the characteristic impedance of the associated feeder which connects the antenna to the wireless device. This resultant mismatching will make it practically impossible for the wireless device to receive the electromagnetic wave selected by tuning the antenna.

Furthermore, the vertical movement of the ferrite magnet in the antenna coil of this prior art device does not cause a substantial variation of inductance because the hollow tube is large in diameter so as to ensure that it is resistive to strong winds and other external forces. More particularly, because the ferrite magnet of this prior art device moves in a large space defined by the hollow tube, there is no appreciable change in inductance even though the ferrite magnet can be moved a relatively long distance along the longitudinal axis of the tube. Accordingly, it has been found that practically no fine tuning is possible with this antenna.

SUMMARY OF THE INVENTION

In view of the defects of the above-described prior art antenna, it is an object of the present invention to provide a helical antenna for use in small, portable wireless devices which has a magnetic tuner movably mounted in the antenna coil of a tube of relatively small diameter in a direction substantially transverse to the longitudinal axis of the antenna thereby permitting the input inductance of the antenna coil to vary substantially with displacement of the magnet element of the magnetic tuner in the diammetrical direction of the helical antenna. Thus, it is an object of the present invention to provide a helical antenna which will permit the effective fine tuning of an associated wireless device to an electromagnetic wave of particular frequency.

Another object of the present invention is to provide such a helical antenna including a capacitance varier or adjuster which is adapted to be connected to an associated feeder for reducing any mismatching between the characteristic impedance of the feeder and the input impedance of the helical antenna which can result from the displacement of the magnet element of the magnetic tuner.

Still another object of the present invention is to provide a helical antenna which can keep the standing wave ratio unchanged after a receiving frequency has been selected irrespective of a relatively broad range of selection.

Other objects, features, and characteristics of the present invention, as well as the methods of operation and functions of the related elements of the structure, and the combination of the parts and economies of manufacture, will become more apparent upon consideration of the following detailed description and the appended claims with reference to the accompanying drawings, all of which form a part of this specification, wherein like reference numerals designate corresponding parts in the various figures.

DETAILED DESCRIPTION OF THE PREFERRED EMBODIMENT

Figure 1:
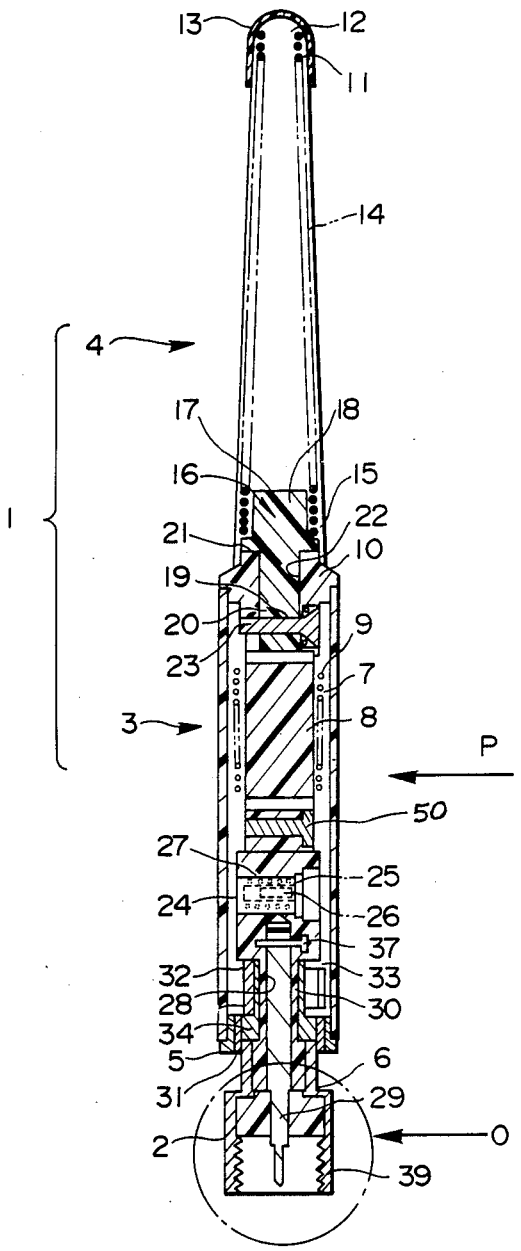
FIG. 1 is a longitudinal cross-sectional view of the helical/antenna formed in accordance with the present invention.
Figure 2:
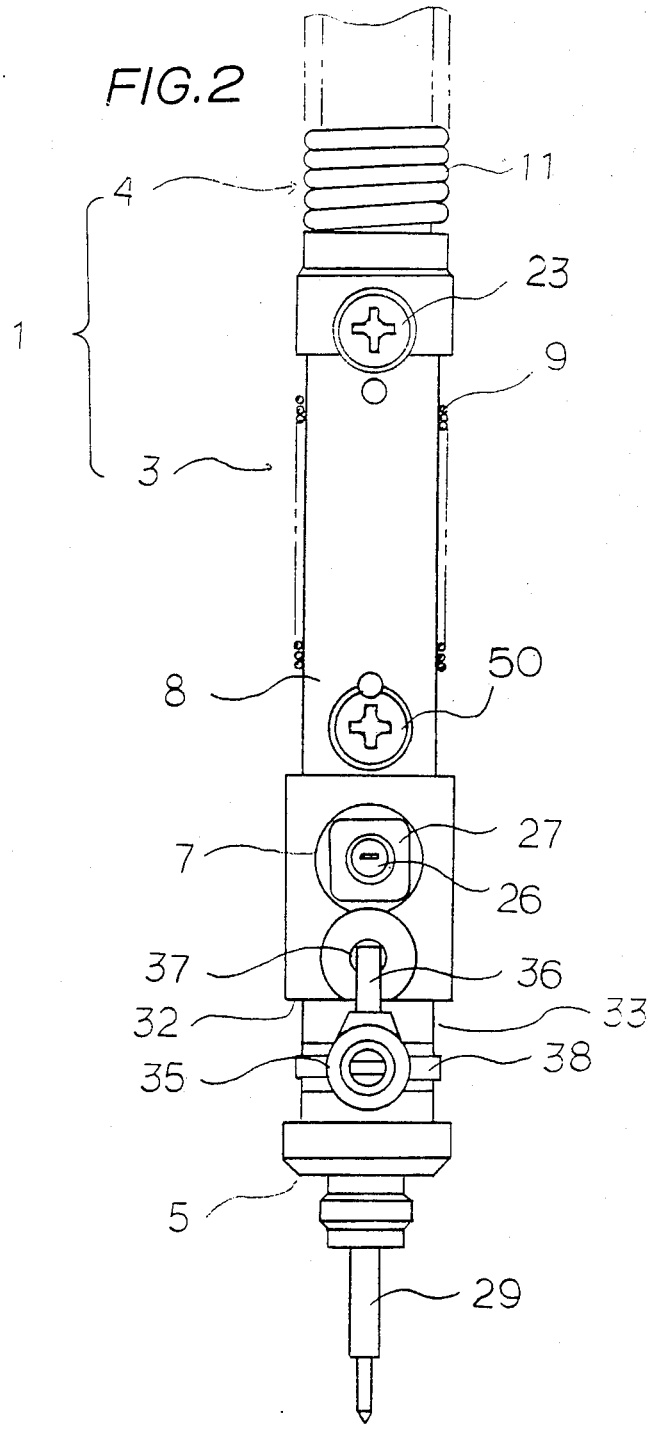
FIG. 2 is an enlarged side elevational view taken in the direction "P" of FIG. 1.
Figure 3:
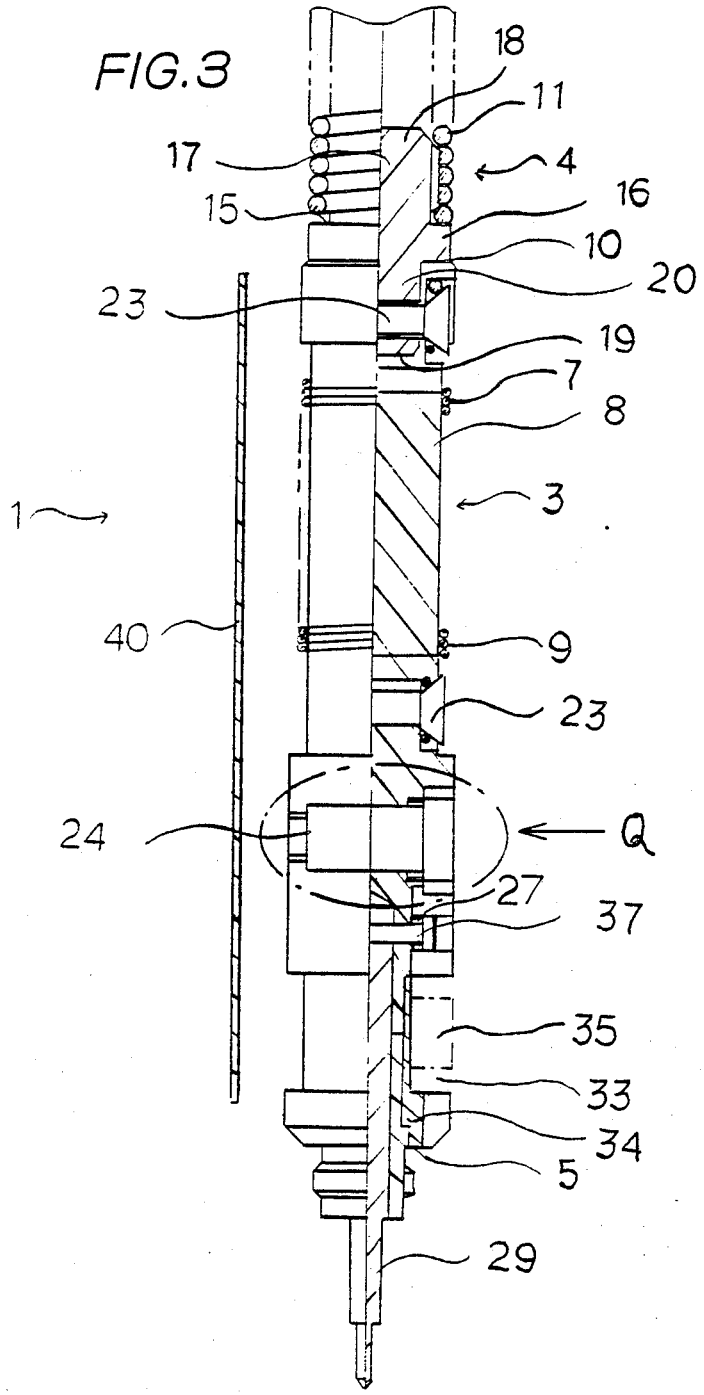
FIG. 3 is a side elevational view similar to FIG. 2 but partly in cross-section.
Figure 4:
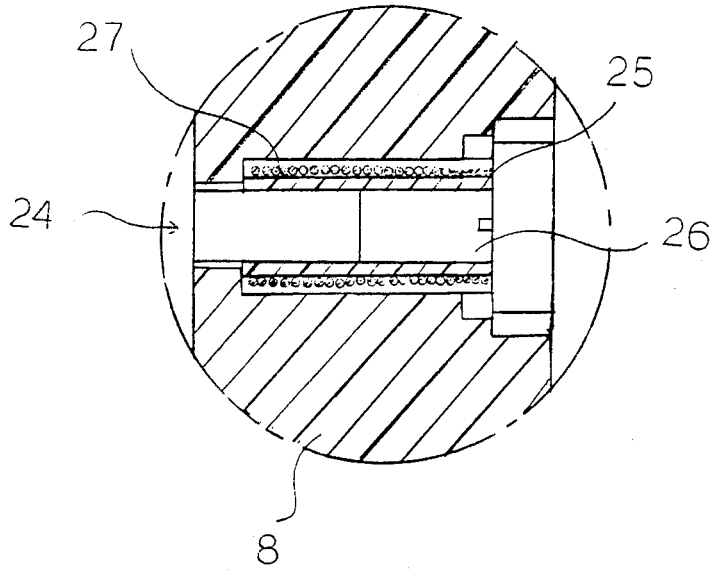
FIG. 4 is an enlarged view of the portion of the antenna indicated as "Q" in FIG. 3.
Figure 5:
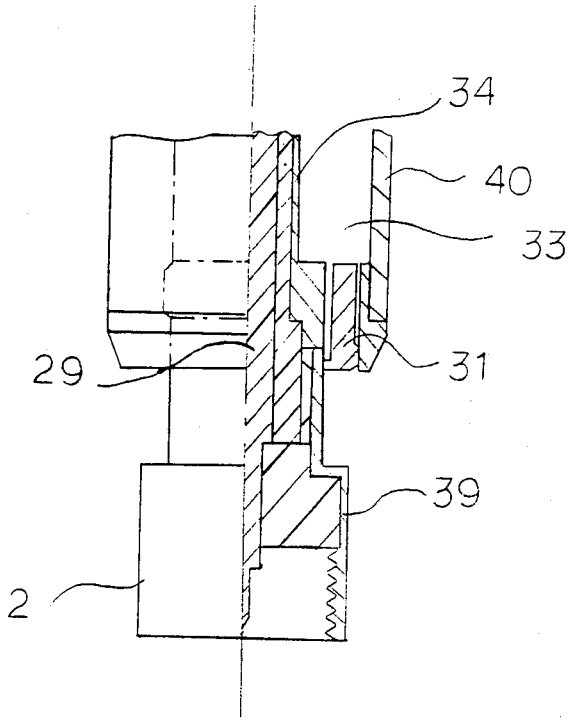
FIG. 5 is an enlarged view, partly in cross-section, of the portion of the antenna marked with "0" in FIG. 1.
Figure 6:
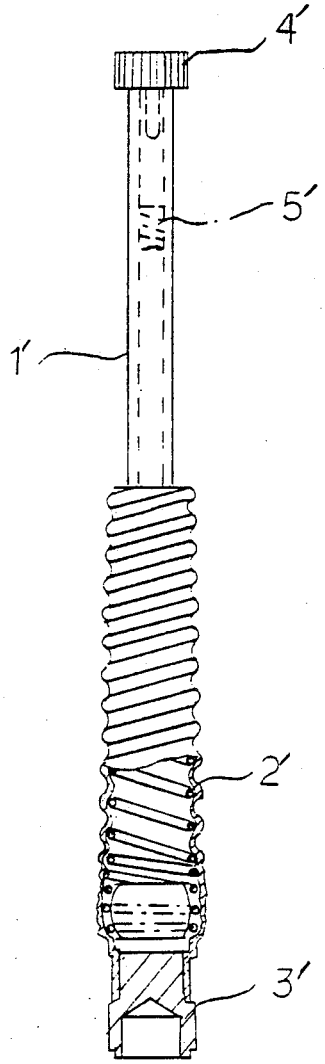
FIG. 6 (PRIOR ART)
FIG. 6 is a view partly in cross-section of a conventional helical antenna.

Referring in particular to FIG. 1, the helical antenna formed in accordance with the present invention is shown generally as element 1. The antenna element includes an antenna connector 2, a first antenna sub-element 3 including a wire coil of relatively small diameter, and a second antenna sub-element 4 including a wire coil of relatively large diameter. Antenna element 1 is, for example, about 320 mm long whereas the second antenna sub-element 4 is, for example, about 200 mm long. Antenna connector 2 is fixed to the bottom end 5 of antenna element 1 and the antenna wire coil 7 of antenna sub-element 3 extends from the top of the antenna connector 2. More particularly, an insulating core rod 8 has a winding of wire 9, for example, enamel wire, of a relatively small diameter wound therearound and the core rod 8 is connected to the top 6 of the antenna connector 2.

Antenna sub-element 3 is connected to antenna sub-element 4 which includes a coil of large diameter wire 11, rising from the top 10 of core rod 8. The wire used in the large diameter wire coil is, for example, about 1.5 mm in diameter. A cap 13 is put on the top end 12 of the antenna sub-element 4 and an expandable sheath 14 is applied to antenna sub-element 4.

As can be seen, antenna sub-element 4 gradually decreases in diameter from the bottom end 15 to the top end 12 thereof. The wire 11 itself preferably made of a conductor that is resilient enough to cause the tapering coil to restore to its original position even if a force should be applied to yieldingly bend the same.

An insulating solid 16 including a relatively large diameter section 18, an annular collar 21, and a relatively small diameter section 19 is provided for interconnecting sub-element 4 and sub-element 3. More particularly, relatively large diameter section 18 is pushed into the bottom end 15 of the tapering wire coil 11 and the relatively small diameter section 19 of the insulating solid is pushed into recess 22 which is provided in the top end of sub-element 3, adjacent to core rod 8. Then, insulating solid 16 is bolted to core rod 8 as, for example, is shown at 23. Coil 7 of sub-element 3 is wound around core rod 8, as set forth above, and is connected to antenna sub-element 4 by the fastener at 23. A magnetic tuner 24 is mounted in the lower portion of core rod 8. The magnetic tuner 24 includes a relatively short hollow cylinder 25 of an insulating material and a ferrite magnet 26 which is movable in hollow cylinder 25. A magnet coil 27 is wound around hollow cylinder 25 and connected to antenna sub-element 3 by a fastener 50. As can be seen, in particular, in FIG. 1, hollow cylinder 25 is mounted so as to have a longitudinal axis which is substantially perpendicular to the longitudinal axis of the antenna element 1 as a whole. Thus, when magnet 26 is moved in cylinder 25, it moves in a direction transverse to the longitudinal axis of antenna 1.

Core rod 8 terminates with a slender hollow extension 30 defining a hollow space 28 which receives a contact pin 29 of antenna connector 2. Contact pin 29 is fixed to core rod 8 by a stopper pin or the like 37 which serves to connect the contact pin 29 to magnet coil 27. Insulator ring 31 formed of, for example, teflon, ABS, etc., is fitted around the lower portion of core rod 8. Thus, an annular recess 33 for accommodating a capacitance adjuster in accordance with the present invention is formed between insulator ring 31 and the transition to the slender extension 30 of core rod 8.

More particularly, the capacitance adjuster or "variable capacitive means" 35 is mounted within annular recess 33 and a variable capacitor metal mount 34 is fixed within the annular recess. Lead wire 36 of the variable capacitance device 35 is connected to stopper pin 37 and hence to the magnetic tuner 24 whereas the other lead wire 38 to the variable capacitive, device 35 is connected to metal mount metal 34. Metal mount 34 is in turn coupled to outer sheath conductor 39 of antenna connector 2. When the antenna connector is fitted in the counter antenna connector of a small portable wireless device, the other lead wire 38 of variable capacitive means 35 will be connected to the chassis of the wireless device and, hence, to the ground.

A protective cover 40 of an insulating material is placed on antenna sub-element 3. Protective cover 40 has two holes for permitting access to the magnetic tuner 24 and the variable capacitor 35. If conditions so require, as will be apparent to the ordinary artisan, a plurality of magnetic tuners and variable capacitors may be used, each allotted two separate divisions of frequency range and marked with numbers representing the division of frequency range for convenience in selecting a desired frequency.

An example in which a helical antenna according to the present invention was used is described below. In this particular example, a helical antenna was used in a small portable wireless device which was designed to handle electromagnetic waves of frequencies ranging from 0 to 10 MHz, specifically, the electromagnetic waves of a plurality of discreet frequencies selected within a broad frequency range. The following description is directed to one of these frequencies.

First, an electromagnetic wave of particular frequency was selected and then the ferrite magnet 26 of magnetic tuner 24 was displaced in the short hollow cylinder 25 in a transverse direction of the helical antenna element 1, thereby varying the input impedance of the helical antenna with the displacement of the ferrite magnet relative to magnet coil 27 wound around hollow cylinder 25 until helical antenna 1 had been tuned to the receiving frequency desired. When this had been accomplished, however, the helical antenna was placed into a mismatched condition with respect to an associated feeder. Thus, the variable capacitor 35 was adjusted to reduce the mismatching between the input impedance of the helical antenna and the antenna feeder which connected the antenna to the wireless device.

As described above, one lead wire of the variable capacitor is connected to the antenna coil and the other lead wire 38 to the variable capacitor connected to the chassis of the wireless device via the antenna connector 2 and the feeder fixed thereto. Accordingly, the adjustment of the variable capacitor caused the characteristic impedance of the feeder to vary.

The above series of steps and resultant adjustment of the device is the same for any other frequencies selected, for example, to realize a best possible receiving condition for the wireless device dependent upon the particular situation, position and other surrounding factors. This feature, then, enables the user to select a most appropriate receiving frequency among a plurality of discreet frequencies in a broad frequency range and to perform the fine tuning to the frequency thus selected.

As described above, ferrite magnet 26 is adapted to move in the hollow cylinder 25 in a direction which is substantially perpendicular to the longitudinal axis of the helical antenna and magnet coil 27 is a dense winding of wire of relatively small diameter. With this arrangement, displacement of the ferrite magnet a very short distance can cause a great change in the input impedance of the antenna. This contributes to the fine adjustment of input impedance. Also, the crosswise arrangement of the tuner 24 permits a substantial reduction of the antenna and system size as a whole. Further, it should be noted that the input impedance of the antenna and the characteristic impedance of the feeder can be exactly matched without changing the standing wave ratio.

While the invention has been described in connection with what is presently considered to be the most practical and preferred embodiment, it is to be understood that the invention is not limited to the disclosed embodiment, but, on the contrary, it is intended to cover various modifications of the preferred arrangements included within the spirit and scope of the appended claims.

What is claimed is:

1. A helical antenna having a longitudinal axis and an antenna connector at a first end thereof for coupling to a small portable wireless device, said antenna having a wire coil defined therein and including a magnetic tuning means comprising:

a hollow cylindrical member formed from an insulating material disposed within said helical antenna so as to have a longitudinal axis extending in a direction substantially perpendicular to the longitudinal axis of the helical antenna;

a magnet element disposed within said hollow cylindrical member and movable along the longitudinal axis of said hollow cylindrical member so as to be movable in a direction substantially perpendicular to the longitudinal axis of the helical antenna; and a wire coil element disposed so as to be wound around said hollow cylindrical member, said wire coil element being electrically coupled to said wire coil of said antenna and to said antenna connector whereby, displacement of said magnet element within said hollow cylindrical member varies the inductance of the antenna so as to selectively tune the antenna to an electromagnetic wave of particular frequency.

2. A helical antenna as in claim 1 wherein said helical antenna further includes a variable capacitance means mounted intermediate said magnetic tuning means and said antenna connector for reducing any mismatching between the characteristic impedance of an antenna feeder of the wireless device and the input impedance of the antenna caused by displacement of said magnet element.

3. A helical antenna as in claim 1, further comprising an antenna sub-element including a core rod of insulating material having a wire coil of a wire of relatively small diameter wound thereround, said wire coil of relatively small diameter being operatively coupled to said magnetic tuning means.

4. A helical antenna as in claim 3, further comprising a second antenna sub-element element including a wire coil of a wire of relatively large diameter and operatively coupled to the first antenna sub-element wire coil and extending upwardly from an upper end of said core rod.

5. A helical antenna as in claim 4, wherein said wire coil of said second antenna sub-element varies in diameter from a largest diameter adjacent said core rod to a smallest diameter at the uppermost end thereto.

6. A helical antenna as in claim 4, further comprising means for interconnecting said first and second antenna sub-elements.

* * * * *